US009499236B1

(12) United States Patent
Arlet

(10) Patent No.: US 9,499,236 B1
(45) Date of Patent: Nov. 22, 2016

(54) EQUIPMENT PROTECTION SLEEVES

(71) Applicant: Erik Arlet, Pittsburgh, PA (US)

(72) Inventor: Erik Arlet, Pittsburgh, PA (US)

(73) Assignee: Pea Marine, LLC, Pittsburgh, PA (US)

( * ) Notice: Subject to any disclaimer, the term of this patent is extended or adjusted under 35 U.S.C. 154(b) by 0 days.

(21) Appl. No.: 14/248,716

(22) Filed: Apr. 9, 2014

(51) Int. Cl.
*B63B 21/04* (2006.01)
*B63B 21/00* (2006.01)

(52) U.S. Cl.
CPC ..... *B63B 21/04* (2013.01); *B63B 2021/003* (2013.01)

(58) Field of Classification Search
USPC ..... 405/211, 212, 216; 114/218, 361, 364; 52/834, 835
See application file for complete search history.

(56) References Cited

U.S. PATENT DOCUMENTS

| | | | | |
|---|---|---|---|---|
| 2,345,795 | A * | 4/1944 | Collyer | 173/130 |
| 3,828,714 | A | 8/1974 | Perkins | |
| RE28,550 | E | 9/1975 | Perkins | |
| 4,019,301 | A * | 4/1977 | Fox | 52/834 |
| 4,353,319 | A | 10/1982 | Ash | |
| 4,685,500 | A | 8/1987 | Silvia | |
| 4,818,148 | A * | 4/1989 | Takeda et al. | 405/234 |
| 5,216,972 | A | 6/1993 | Dufrene et al. | |
| 5,327,844 | A | 7/1994 | Kress | |
| 6,357,196 | B1 * | 3/2002 | McCombs | 52/845 |
| 6,471,627 | B2 | 10/2002 | Chapman et al. | |
| 7,811,513 | B2 * | 10/2010 | Johnson et al. | 422/6 |
| 8,333,162 | B2 | 12/2012 | Chapman et al. | |
| 2015/0266546 | A1 * | 9/2015 | Petersen | B63B 21/04 248/49 |

FOREIGN PATENT DOCUMENTS

| | | | |
|---|---|---|---|
| JP | 05156656 | * | 6/1993 |

* cited by examiner

*Primary Examiner* — Sean Andrish
(74) *Attorney, Agent, or Firm* — Cohen & Grigsby, P.C.

(57) ABSTRACT

A protective sleeve for a piece of equipment, such as a marine deck or dock structure, which is intended for contact with wire rope is disclosed. The protective sleeve comprises at least one sleeve section shaped to conform to a portion of a peripheral surface of the equipment. The at least one sleeve section may comprise a first end portion, a second end portion, and a means for connecting the at least one sleeve section in end-to-end relation by connecting at least the first end portion of a first sleeve section to the second end portion of the same sleeve section or an adjacent sleeve section. In certain embodiments, the protective sleeve may be composed of a durable polymer material having a Shore D hardness of greater than about 60 or a Shore A hardness of greater than about 85.

20 Claims, 13 Drawing Sheets

EQUIPMENT PROTECTION SLEEVES

BACKGROUND

1. Technical Field of the Invention

This invention pertains generally to durable polymer sleeves which provide a non-abrasive surface for synthetic line on the rope contacting surfaces of various types of equipment. More specifically, the invention pertains to durable protective sleeves for the rope contacting surfaces on a marine deck or dock which reduce the wear on synthetic lines.

2. Description of the Related Art

Marine vessels typically rely on ropes to hold them securely on a dock. For over 150 years, the marine industry has been using wire rope to make its barge-to-barge, boat-to-barge, and mooring connections. Although wire rope is strong, it can be very dangerous for the marine worker because it is heavy and retains memory that creates uncontrolled and unpredictable stored energy. For example, wire rope can become fouled and/or bird nested when wound onto a winch drum. This can lead to injuries related to quickly released slack from the rope while manually releasing or tightening the winch drum, and specifically injuries to the worker's arms and hands while handling the rope to "free" and re-spool it properly. Further, the memory and kinks in the wire rope significantly weaken the strength and viability of the wire when stored in a wound state for any length of time.

As the wire ropes deteriorate over time due to fatigue, corrosion, abrasion, mechanical damage, and overheating, they become even more dangerous to work with. Broken strands of wire and frayed wire can lead to lacerations and wounds on the hands, arms and legs of the marine worker. Furthermore, such damage significantly weakens the strength and viability of the wire creating the possibility of additional dangers for the marine worker due to rope failure.

A recent solution to the aforementioned problems has been to use synthetic lines. Current boat-to-barge, barge-to-barge, and mooring connections all utilize deck and dock fittings intended to be used with wire rope. These fittings are most commonly made of cast steel that rusts, and contains burrs and sharp edged grooves, all of which create an abrasive surface and are non-conducive to use with synthetic line.

Accordingly, there exists a need in the prior art for deck and dock fittings, or durable covers for existing fittings, which are compatible with synthetic line.

SUMMARY

The presently disclosed invention overcomes many of the shortcomings of the prior art by providing durable covers for the rope contacting surfaces on various types of equipment which reduce the wear on synthetic lines. The covers may be installed and uninstalled with ease and in certain cases may be portable. The covers may be composed of durable polymers which provide a smooth low friction surface which is abrasion resistant. The durable polymers may include at least nylon, polyester, polyether, polycarbonate, polystyrene, polyurethane, specially blended urethane polymers, polyethylene, polytetrafluorethylene, high molecular weight polyethylene, ultra high molecular weight polyethylene, hard rubber combined with other materials, or combinations thereof. In general, any durable polymer having a Shore D hardness of greater than about 60 or a Shore A hardness of greater than about 85 may be used to form the protective sleeves or covers of the presently disclosed invention. The exact polymer selected may depend on the size of the protective cover or sleeve, the environment in which it will be used, and the specific type of work and work load to which it will be subjected.

In certain embodiments, the durable polymer material may be thermosetting cast polyurethane having a Shore D hardness of about 65 or a Shore A hardness of about 95. In certain embodiments, the polymeric material may be polyurethane formed from the polyol polytetramethylene ether glycol (PTMEG) and an isocyanate.

These durable polymers may create a low coefficient of friction cover that may fit over existing fittings or equipment which was intended for use with wire rope, and thus provide the user with the ability to use synthetic lines without harming the line. Further, these covers may still be strong enough to withstand the rigors of wire rope in the event a user chooses to use such.

The covers of the presently disclosed invention may be used to cover any type of equipment or fitting normally used with wire rope. Examples of such equipment include marine equipment, such as a deck or dock structures normally used for wire rope contact. Non-limiting examples of such deck or dock structures include at least bollards, chocks, roller chocks, cleats, kevels, capstans, winches, sheaves, buttons, bits, double bits, H-bits, side bits, fairleads, fairlead rollers, deck or dock perimeters, pilings, dauphins, and mooring rings. The covers may also be used to cover equipment used for towing, such as the winches and rigging found in a tow truck or vehicle, or for rigging, such as the rigging used by window washers and painters. Further, other industries may find these covers useful, such as the logging industry which has recently begun to switch from wire rope to synthetic line.

The covers of the presently disclosed invention may comprise means for attaching the covers about a peripheral surface of the various types of equipment. Such means may include at least adhesives, hook and loop closures, magnets, various types of tape, complementary teeth at opposing end, screws, or nuts and bolts. Each of these attachment means may be used individually or in combination, and may be used to attach the cover to the equipment, such as by screwing the cover directly to the equipment, and/or may be used to attach cover sections to each other around the equipment. For example, the cover for a winch may comprise a single section having complimentary projections/indents at opposing ends and magnets embedded within the single section. The magnets may hold the section onto the equipment and the complimentary projections/indents at the opposing ends may be fitted together to secure the section to itself thus forming a cover. The ends may be further secured using an adhesive.

According to its major aspects, and briefly stated, the presently disclosed invention includes a protective sleeve for the rope contacting surfaces on a piece of equipment. The protective sleeve may comprise at least one sleeve section shaped to conform to a portion of a peripheral surface of the equipment. Each sleeve section may comprise a first end portion and a second end portion, and a means for attaching the at least one sleeve section by attaching at least the first end portion of a first sleeve section to the second end portion of either the same sleeve section or an adjacent sleeve section. In certain embodiments, the protective sleeve may be composed of a durable polymer having a Shore D hardness of greater than about 60 or a Shore A hardness of greater than about 85.

In various embodiments of the protective sleeve, the means for connecting the at least one sleeve section may be a screw or nut and bolt, and the at least one sleeve section may comprise at least one channel at each of the first end portion and the second end portion, wherein the at least one channel is configured to accept the screw or nut and bolt. Alternatively, the at least one sleeve section may comprise at least one row of inset teeth at each of the first end portion and the second end portion, wherein the means for connecting the at least one sleeve section may be by contact between the at least one row of teeth on the first end portion of the first sleeve section to the at least one row of teeth on the second end portion of the same sleeve section or an adjacent sleeve section. In this last configuration, each sleeve section may further comprise at least one channel at each of the first end portion and the second end portion which is configured to accept a screw or nut and bolt. In certain other embodiments, the first end portion may have at least one projection configured to fit within at least one indent on the second end portion of the same sleeve section or of an adjacent sleeve section.

In various other embodiments of the protective sleeve, the means for connecting the at least two sleeve sections may comprise ultra-high bond (UHB) or very high bond (VHB) tape, such as VHB™ tape available from 3M™ United States, magnets, hook and loop closures, such as Velcro® available from Velcro Industries, glue or adhesive, or combinations thereof. Such materials may be placed on facing ends of the at least one sleeve section and may be used alone or in combination as suggested, or in addition to the screw or nut and bolt mentioned above.

In various embodiments of the protective sleeve, each section may further comprise at least one magnet which is configured to contact the peripheral surface of the equipment. The magnet may be embedded within the protective sleeve, or may be positioned on an inner surface of the protective sleeve which is adjacent to the peripheral surface of the equipment. In preferred embodiments, each section may comprise at least two magnets, at least three magnets, or at least four magnets configured to contact the peripheral surface of the equipment.

The presently disclosed invention also includes a protective cover for a rope contacting structure on a marine dock or deck. The cover may comprise at least two semi-cylindrical sections shaped to conform to a peripheral surface of the rope contacting structure, wherein each section may be composed of a durable polymer having a Shore D hardness of greater than about 60 or a Shore A hardness of greater than about 85. Each section may comprise a base portion, a top portion, a center column portion connecting the base portion and the top portion, a first axial end portion having an end surface, and a second axial end portion having an end surface. The cover further comprises a means for connecting the at least two sections in face-to-face relation by connecting at least the first axial end portion surface of a first section to the second axial end portion surface of an adjacent section, wherein the cover has a vertical axis aligned with a vertical axis of the rope contacting structure.

In various embodiments of the protective cover, the means for connecting the at least two semi-cylindrical sections may be at least one screw or one nut and bolt set, and the at least two sections may comprise at least one channel at each of the first axial end portion and the second axial end portion, wherein the at least one channel is configured to accept the screw or nut and bolt. Alternatively, the at least two semi-cylindrical sections may comprise at least one row of inset teeth at each of the first axial end portion and the second axial end portion, wherein the means for connecting the at least two sections is by contact between the at least one row of teeth on the first axial end portion of the first section to the at least one row of teeth on the second axial end portion of the adjacent section. In this later configuration, the at least two semi-cylindrical sections may further comprise at least one channel at each of the first axial end portion and the second axial end portion which is configured to accept a screw or nut and bolt.

In certain embodiments of the protective cover, the top portion and the base portion of the at least one semi-cylindrical section may extend laterally outward from the column portion. Further, the first axial end portion surface may have at least one projection configured to fit within at least one indent on the second axial end portion surface of an adjacent semi-cylindrical section.

The presently disclosed invention also includes a protective cover for a cleat or kevel on a boat or barge deck, where the cover comprises two sections shaped to conform to a peripheral surface of the cleat or kevel. Each section may be composed of a durable polymer having a Shore D hardness of greater than about 60 or a Shore A hardness of greater than about 85. Further, each section may comprise a base portion, a top portion, at least one center column portion connecting the base portion and the top portion, a lateral edge having at least one channel therethrough, and a means for connecting the two sections in face-to-face relation by contacting the lateral edges of each section. The means for connecting the at least two sections may be a screw or nut and bolt.

The presently disclosed invention also includes a protective cover for a marine deck or dock perimeter. The cover may comprise a top portion and a base portion, wherein the cover is configured to conceal at least the portion of the peripheral or edge surface of the deck or dock perimeter which is contacted by wire rope. The protective cover may further comprise at least one hook configured to attach to a corresponding hook or loop on the marine deck or dock, or which may be used to attach the cover to the marine dock or deck by connection means such as a screw or nut and bolt set. The protective cover may further comprise at least one magnet configured to contact or hold onto the marine deck or dock perimeter.

The presently disclosed invention also includes methods for protecting synthetic line from abrasion or damage on structures intended for contact with wire rope. The method may comprise providing at least one protective cover or sleeve comprising at least one sleeve or cover section, as disclosed above. The at least one section may be placed around the structure so that a first end portion of the at least one sleeve section is proximate to a second end portion of either the same sleeve section or an adjacent sleeve section. The at least one sleeve section may then be secured onto the structure by attaching the first end portion to the proximate second end portion. Attachment may be by any means previously disclosed.

BRIEF DESCRIPTION OF THE DRAWINGS

Aspects, features, benefits and advantages of the embodiments herein will be apparent with regard to the following description, appended claims, and accompanying drawings. In the following figures, like numerals represent like features in the various views. It is to be noted that features and components in these drawings, illustrating the views of embodiments of the present invention, unless stated to be otherwise, are not necessarily drawn to scale.

DETAILED DESCRIPTION

Figure 1A:
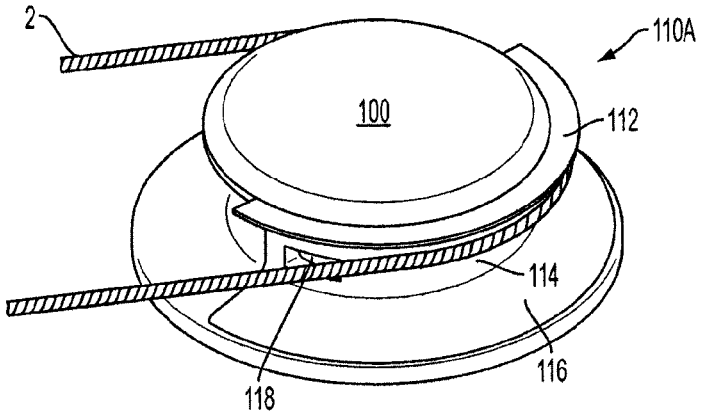
FIG. 1A-1C illustrate perspective views of a marine button partially covered by a protective cover in accordance with certain aspects of the present invention.

In the following description, the presently disclosed invention is set forth in the context of various alternative embodiments and implementations involving durable polymer sleeves which provide a non-abrasive surface for synthetic line on the rope contacting surfaces of various types of equipment. The equipment protection sleeves may be used to cover any type of equipment or fitting normally used with wire rope, and provides a low coefficient of friction cover which reduces wear on the synthetic line and protects the line from damage.

Various aspects of the equipment protection sleeves may be illustrated by describing components that are coupled, attached, and/or joined together. As used herein, the terms "coupled", "attached", and/or "joined" are interchangeably used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements shown in said examples.

Various aspects of the equipment protection sleeves may be illustrated with reference to one or more exemplary implementations. As used herein, the term "exemplary" means "serving as an example, instance, or illustration," and should not necessarily be construed as preferred or advantageous over other variations of the devices, systems, or methods disclosed herein. "Optional" or "optionally" means that the subsequently described event or circumstance may or may not occur, and that the description includes instances where the event occurs and instances where it does not. In addition, the word "comprising" as used herein means "including, but not limited to".

Relative terms such as "lower" or "bottom" and "upper" or "top" may be used herein to describe one element's relationship to another element illustrated in the drawings. It will be understood that relative terms are intended to encompass different orientations of aspects of the equipment protection sleeves in addition to the orientation depicted in the drawings. By way of example, if aspects of the equipment protection sleeves shown in the drawings are turned over, elements described as being on the "bottom" side of the other elements would then be oriented on the "top" side of the other elements as shown in the relevant drawing. The term "bottom" can therefore encompass both an orientation of "bottom" and "top" depending on the particular orientation of the drawing.

Other than in the operating examples, or where otherwise indicated, all numbers expressing quantities, ratios, ranges, etc. used herein are to be understood as modified in all instances by the term "about" even though the term "about" may not expressly appear with the value, amount or range.

It must also be noted that as used herein and in the appended claims, the singular forms "a", "an", and "the" include the plural reference unless the context clearly dictates otherwise. Thus, for example, reference to a "sleeve" is a reference to one or more sleeves and equivalents thereof, and so forth. Unless defined otherwise, all technical and scientific terms used herein have the same meanings as commonly understood by one of ordinary skill in the art.

The presently disclosed invention includes protective covers for various types of equipment, including at least marine deck or dock equipment such as cleats, chocks, bits, buttons, kevels, capstans, winches, sheaves, fairleads, and bollards. The following definitions are provided for clarity only, and are not meant to be limiting of the presently disclosed invention. For example, while a winch is indicated here as a type of marine deck or dock equipment, such may be found on land vehicles, rescue vehicles, or in other types of industry, such as the logging industry.

As used herein, the term "cleat" may be taken to mean a type of fixture found on docks and vessels, typically shaped like a very wide and short capital letter T. Closed types of cleats may have a solid base while open types may have two closely spaced legs in the center. In use, a line with a loop on the end can be passed through the legs and secured over the top portion (top of the T).

As used herein, the term "chock" may be taken to mean a type of fixture typically found on a vessel which is designed to hold a line rather than using it as a tie point. A chock may be found near a cleat and generally is used to keep the line in position so it does not move laterally and chafe or abrade. Chocks are generally designed as flattened loops that have a narrow opening at the top to accept and remove the line.

As used herein, the term "bit" may be taken to mean a type of fixture which is a solid column (square or cylindrical) having a cross bar that is of a lesser diameter and which forms a lowercase letter t. While bits are mostly found on vessels near the bow and stern, they may be used on docks is there is a need to use something taller than a cleat in order to accept large diameter lines.

As used herein, the term "button" may be taken to mean a type of fixture which is a solid cylindrical column and which may be used to thread cable between boats or barges and/or a dock. As used herein, the term "bollard" may be taken to mean a type of fixture which is a solid cylindrical column and which may be used to thread cable between boats or barges and/or a dock. Bollards are typically larger than buttons and are most commonly found on docks and large ships.

As used herein, the term "capstan" may be taken to mean a type of fixture which is a revolving drum, with a vertical axis, that is used for heaving in lines. As used herein, the term "winch" may be taken to mean a type of fixture which is a revolving drum, with a horizontal axis, that is used for heaving in lines. As used herein, the term "sheave" may be taken to refer to a pulley wheel that turns inside a block, and which contacts the rope. As used herein, the term "fairlead" may be taken to mean a type of fixture which is used to guide a line, rope or cable around an object, either out of the way or to stop it from moving laterally. Typically a fairlead will be a ring or hook. A fairlead may be a separate piece of hardware, or it could be a channel in the structure of the deck or dock.

A typical wire rope is about 1 inch by 65 feet and weighs over 120 pounds. Replacing that rope with a synthetic line reduces the weight to a little over 15 pounds, or about 87% lighter than the wire rope. Further, in addition to being lighter, that same synthetic line is also 14% stronger (1 inch wire breaking strength=103,400 lbs. of line pull; 1 inch synthetic breaking strength=120,000 lbs. of line pull). Synthetic line has no memory so there is no stored energy (e.g. no violent backlash when broken under high loads), it floats in water, and greatly reduces the tripping hazards on barge decks. Additionally, synthetic line will not accumulate the burrs that wire rope does, and thus eliminates the danger of lacerations a worker faces when handling with wire rope.

Synthetic line is also more efficient than wire rope. Only one person is needed for winch operation (eliminates the need for two people), making and breaking connections can be done more quickly without sacrificing safety, and the take up of slack and final tensioning on any tensioning device is easier and faster. Thus, the use of synthetic line represents a huge improvement in both the ease and efficiency of operation and safety for the worker.

While synthetic line has many advantages over wire rope, it has not been globally adopted. For example, in the marine industry current boat-to-barge, barge-to-barge, and mooring connections all utilize fittings intended to be used with wire rope. These fittings are most commonly made of cast steel that rusts, and contains burrs and sharp edged grooves, all of which create an abrasive surface which is non-conducive to use with synthetic line. The protective covers of the presently disclosed invention solve this problem by providing smooth, durable polymer covers which offer a low coefficient of friction surface for the synthetic line.

These covers may be manufactured and used on any type/style of equipment normally intended for contact with wire rope. For example, the covers may be used on marine deck or dock structures normally used with wire rope. Non-limiting examples of such deck or dock structures include at least bollards, chocks, roller chocks, cleats, kevels, capstans, winches, sheaves, buttons, bits, double bits, H-bits, side bits, fairleads, fairlead rollers, deck or dock perimeters, pilings, dauphins, and mooring rings. The covers are lightweight, weather resistant and only require simple tools for installation or removal, such as for the removal and re-installation required for deck fitting inspection or replacement.

Figure 1B:
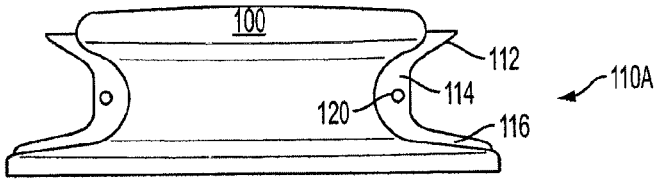

Referring now to the drawings, embodiments of the protective sleeves or covers of the presently disclosed invention are shown in FIGS. 1-13. FIG. 1A illustrates a perspective view of a 6 inch marine button generally designated by reference number 100 partially covered by a protective sleeve or cover section generally designated by reference number 110A, wherein the protective sleeve or cover 110A provides a smooth surface which is suitable for contact by a synthetic line 2. As shown in FIG. 1A, the protective sleeve may comprise two sleeve sections (showing only one section in FIGS. 1A-1C), wherein each section comprises a top portion 112, a base portion 116, and a center column portion 114 which connects the top portion and the base portion. Each sleeve section 110A may further comprise a first end portion and a second end portion, as is shown in FIG. 1B. Screws or nuts and bolts may be used to connect the sleeve sections along facing ends. An indent 118 may be provided to assist in insertion of the screw or nut and bolt set used to connect the sleeve sections along facing ends, as well as a predrilled channel, which is shown as 120 in FIG. 1B.

Figure 1C:
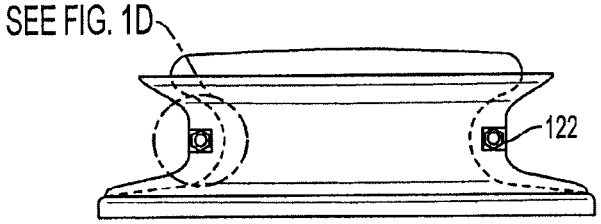
Figure 1D:
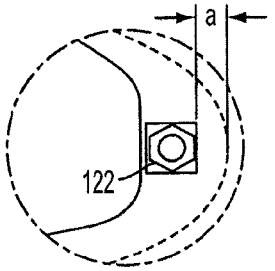
FIG. 1D illustrates an exploded view of a portion of the protective cover shown in FIG. 1C pointing out the connection point between two portions of the protective cover in accordance with certain aspects of the present invention.

FIG. 1C illustrates a side view of the button 100 partially covered by a protective cover section 110A, and further pointing out placement of the connection means 122 through the predrilled channels. FIG. 1D illustrates an exploded view of the connection means from FIG. 1C, which shows a possible placement position for the nut and bolt set 122 within the sleeve section. The distance "a" between the edge of the connection means 122 and side of the sleeve section which faces the peripheral surface of the marine button may be large enough to maintain structural integrity and strength for the sleeve section and may depend on at least the overall size of the equipment to be covered and the material of the protective sleeve.

In the various embodiments of the sleeves or covers disclosed herein, possible connection means include screws and/or nuts and bolts which may be used to secure the various sleeve or cover sections to one another and/or to the rope contacting surface. The screws or nuts and bolts may be formed of any material known in the art. In preferred embodiments, these parts may be formed from non-corrosive materials such as, for example, stainless steel, nylon, or other plastics or polymers.

With continued reference to FIG. 1D, the connection means 122 may be a nut and bolt, as shown. The bolt may be a socket head cap screw having an outer head diameter which is the same as the matching nut. As such, the indent which accepts the nut and bolt 122 may be the same on both sides/ends of the protective sleeve section. This may reduce production costs for the sleeve sections and make installation easier as each section may be identical. Further, in certain embodiments, the indent may be hexagonal in shape and may provide a tight fit for a comparably sized nut. This may make installation of the connection means quicker and easier because only a single tool would be required to install the bolt side (via the socket head cap) of the connection means.

Figure 2A:
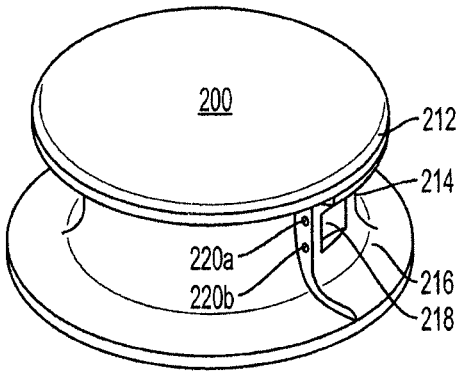
FIG. 2A-2B illustrate perspective views of a marine button partially covered by a protective cover in accordance with certain aspects of the present invention.
Figure 2B:
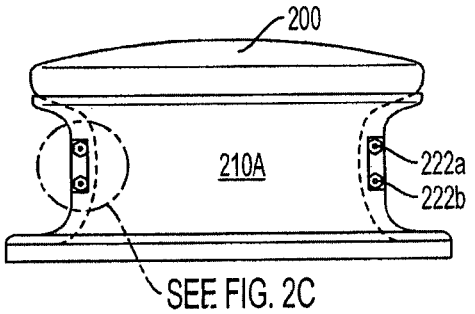

FIGS. 2A-2B illustrate perspective views of a 10 inch marine button generally designated by reference number 200 partially covered by a protective sleeve section. With reference to FIG. 2A, the protective sleeve may comprise two sleeve sections (showing only one section in FIG. 2A), wherein each section comprises a top portion 212, a base portion 216, and a center column portion 214 which connects the top portion and the base portion. Each sleeve section may further comprise a first end portion and a second end portion having predrilled channels (220*a*, 220*b*). Screws or nuts and bolts which may be used to connect the sleeve sections along facing ends may be inserted through these channels. An indent 218 may be provided to assist in insertion of the screw or nut and bolt set used to connect the sleeve sections.

Figure 2C:
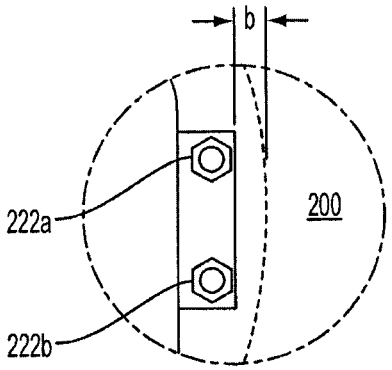
FIG. 2C illustrates an exploded view of a portion of the protective cover shown in FIG. 2B pointing out the connection point between two portions of the protective cover in accordance with certain aspects of the present invention.

FIG. 2B illustrates a side view of the button 200 partially covered by the protective cover 210A, and further pointing out placement of the connection means (222*a*, 222*b*) through the predrilled channels. FIG. 2C illustrates an exploded view of the connection means from FIG. 2B, which shows a possible placement position for a nut and bolt set (222*a*, 222*b*) within the sleeve section. As with the embodiment shown in FIG. 1D, the distance "b" between the edge of the connection means 222 and side of the sleeve section which faces the peripheral surface of the marine button may be large enough to maintain structural integrity and strength for the sleeve section and may depend on at least the overall size of the equipment to be covered and the material of the protective sleeve.

Further, and with continued reference to FIG. 2C, the bolts may be socket head cap screws having outer head diameters which are the same as the matching nuts. As such, the indents which accept the nut and bolt sets (222*a*, 222*b*) may be the same on both sides/ends of the protective sleeve section. As discussed above, this may reduce production costs for the sleeve sections and make installation of the cover easier as each section may be identical.

Figure 4:
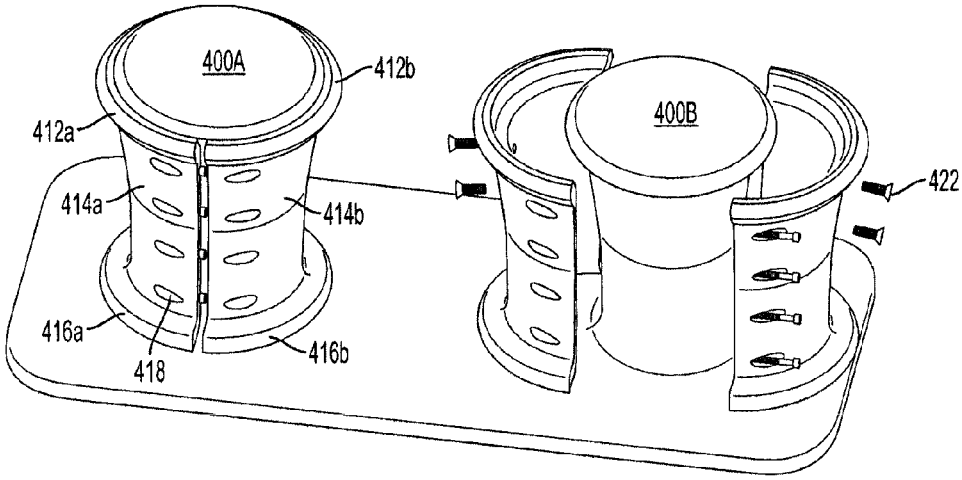
FIG. 4 illustrates a perspective view of a marine double bit partially covered by an alternative embodiment of a protective cover in accordance with certain aspects of the present invention.
Figure 5:
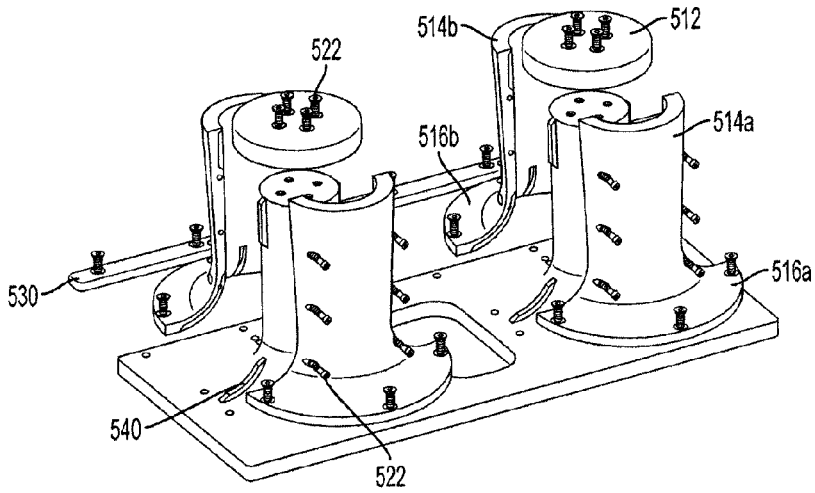
FIG. 5 illustrates a perspective view of a marine double bit partially covered by another alternative embodiment of a protective cover in accordance with certain aspects of the present invention.
Figure 8:
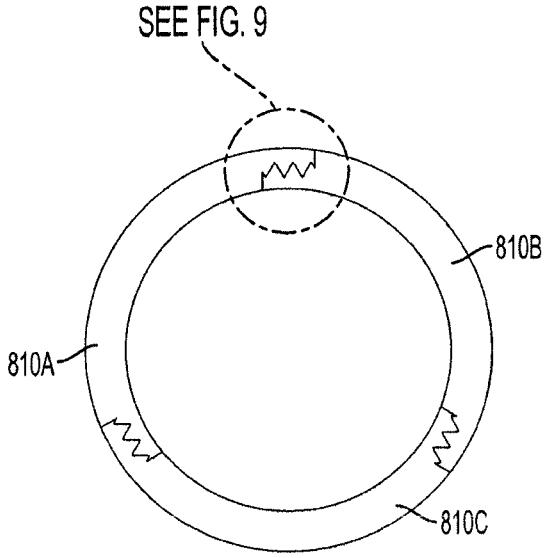
FIG. 8 illustrates a top view of a protective cover comprising three sections in accordance with certain aspects of the present invention.
Figure 9:
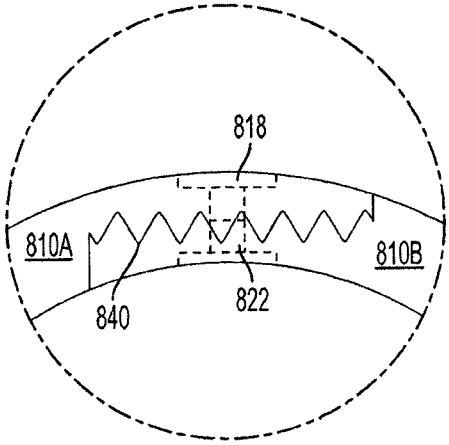
FIG. 9 illustrates an exploded view of the connection point between two portions of the protective cover shown in FIG. 8 in accordance with certain aspects of the present invention.

While the embodiment of the protective sleeve or cover shown in FIGS. 1A-1D contain only a single connection means (120, 122), and the embodiment shown in FIGS. 2A-2C contain two connection means (220*a*, 220*b*, 222*a*, 222*b*), various other numbers of connection means and types of connection means are envisioned and are within the scope of the presently disclosed invention (see for example FIGS. 4 and 5). Further, various types of connections means may be combined. For example, as shown in FIGS. 8 and 9, each sleeve section may comprise at least one row of inset teeth (840) at each of the first end portion and the second end portion. Contact between the at least one row of teeth on the first end portion of the first sleeve section (810A) and the at least one row of teeth on the second end portion of an adjacent sleeve section (810B) may lock the two sleeve sections together. In certain embodiments, each sleeve section may further comprise at least one channel 818 at each of the first end portion and the second end portion which is configured to accept a screw or nut and bolt 822 (see FIG. 9), as was shown in the embodiments of FIGS. 1A-1D.

Additionally, while the embodiments of the protective sleeve or cover shown in each of FIGS. 1-7 and FIG. 12 comprise two sections or portions, other configurations are within the scope of the presently disclosed invention. For example, the embodiment shown in FIG. 8 comprises three sleeve sections (810A, 810B, 810C), while the embodiment shown in FIG. 13 comprises only one sleeve section.

In various embodiments of the protective sleeve, each section may further comprise at least one magnet which is configured to contact the peripheral surface of the equipment to be covered. The magnet may be embedded within the protective sleeve, or may be positioned on an inner surface of the protective sleeve which is adjacent to the peripheral surface of the equipment. The magnet may aid in placing and/or holding the sleeve on the peripheral surface of the equipment during installation.

Figure 12A:
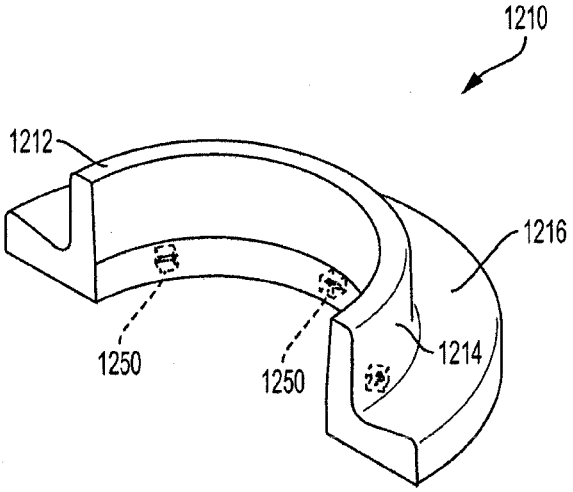
FIGS. 12A-12B illustrate perspective views of a portable protective cover in accordance with certain aspects of the present invention.

Shown in FIG. 12A is a portable protective sleeve. In certain embodiments, the portable protective sleeve may be designed for a rope contacting surface on a marine dock or deck. In certain embodiments, the protective cover may comprise at least two sleeve sections (shown in FIG. 12A is one sleeve section 1210), wherein each sleeve section has an upper rim portion 1212, a center column portion 1214, and a bottom portion 1214. In the embodiment shown, the bottom portion 1216 extends outward and upward from the vertical axis of the sleeve, and thus provides a trough in which the synthetic line may reside. Further, the at least two sleeve sections may be attached to the rope contacting surface by magnets 1250, which are shown to be on an inner surface the protection sleeve section 1210 that would be adjacent to the peripheral surface of the rope contacting structure. These magnets may be positioned on an inner surface of each sleeve section in slots, or may be embedded within the protective sleeve sections, as is shown in FIG. 12B (1212 and 1216 are shown for reference).

Figure 12B:
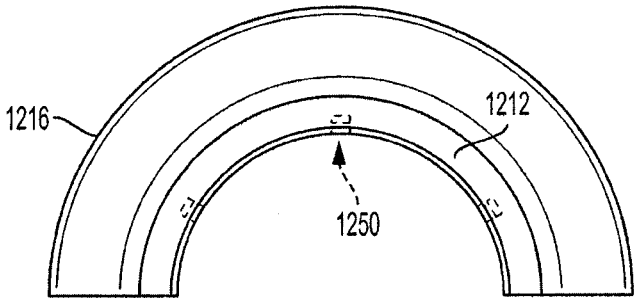

The magnets included in the portable protective sleeve sections shown in FIGS. 12A and 12B may be the only means needed for attaching the sleeve to the rope contacting surface on the marine dock or deck. Installation may be as simple as placing the sleeve sections around the rope contacting surface of the marine equipment. In this way, the protective sleeve may be installed or removed rapidly and with ease and may be used as a portable part of the dock or deck equipment. Thus, a boat which uses synthetic line may make connections to a dock or another vessel having only steel mooring equipment by simply installing the portable sleeve around the mooring equipment in order to protect their synthetic line, or by removing the protective sleeve from their own deck equipment so that wire rope may be used.

In other embodiments, each section may further comprise at least one magnet at one end portion and a magnetically responsive material at the other end portion configured to make contact with the magnet on an end portion of an adjacent section. These later magnets may aid in placing and holding sleeve or cover sections together before the attachment means (screws or nuts and bolts) can be introduced. In certain embodiments, the magnets may be used without the other attachment means (screws or nuts and bolts) to attach the sleeve sections around the rope contacting surface.

These magnets may be hard or permanent magnets which are placed at specific positions, as described above, or may be magnetic polymers, which may be placed at any position along the sleeve section such as, for example, an inner or end portion layer. Magnetic polymer materials are advantageous as they can be easily and cheaply formed into complex shapes, and can be corrosion resistant and low friction. Exemplary materials include Dupont™ Teflon®, hard rubber, or nylon mixed with atomized ferromagnetic material. Other similar cheap polymers include epoxy and polyester resins. The use of such magnetic polymers avoids the use of traditional ferrite block and metal parts, which are heavy and costly to cut and shape, especially when the shape may be curved.

In certain embodiments, portions of the ends of each protective sleeve or cover may further comprise ultra-high bond (UHB) or very high bond (VHB) tape, such as 3M™ VHB™ tape, which may aid in placing and holding sleeve or cover sections together before the attachment means (screws or nuts and bolts) can be introduced. Such tape may also be placed on any portion of an interior surface of each sleeve section which is adjacent to the peripheral surface of the equipment. As such, the tape may aid in placing and/or holding the sleeve on the peripheral surface of the equipment during installation.

In various embodiments of the protective sleeve, each section may further comprise at least one section of hook and loop fastener, such as Velcro®, which is configured to contact a complimentary section of hook and loop fastener placed on the peripheral surface of the equipment. As with the tapes and magnets discussed above, these fasteners may aid in placing and/or holding the sleeve on the peripheral surface of the equipment during installation. Further, and as discussed above for the tape and magnets, each section may comprise one section of Velcro® or hook and loop fastener at an end portion which is configured to contact a complimentary section of Velcro® or hook and loop fastener placed at the other end portion. In this way, adjacent facing ends of the sleeve sections may be brought together and held in place while a secondary connection means is inserted. Other connection means include at least glues or adhesives.

Figure 3A:
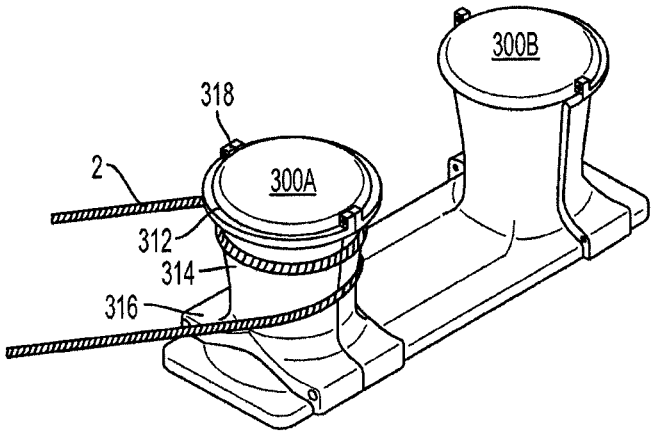
FIG. 3A-3C illustrate perspective views of a marine double bit partially covered by a protective cover in accordance with certain aspects of the present invention.
Figure 3B:
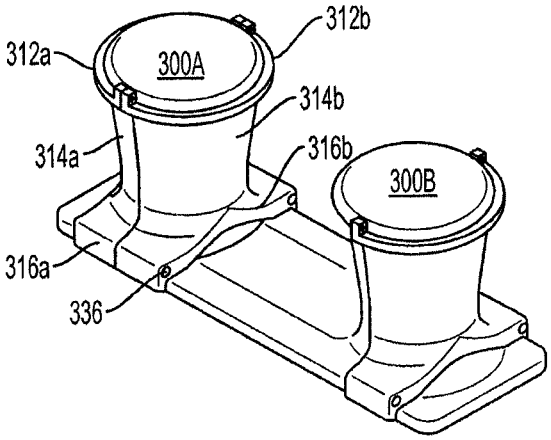
Figure 3C:
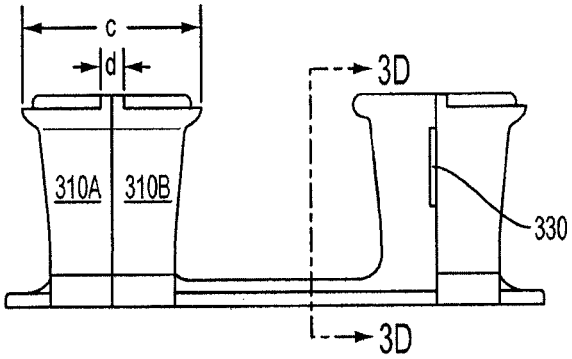

FIGS. 3A-3C illustrate perspective views of a marine double bit partially covered by a protective sleeve according to embodiments of the presently disclosed invention. Each column (300A or 300B) of the double bit may be covered by at least two sleeve sections, wherein the protective sleeve provides a smooth surface which is suitable for contact by a synthetic line 2. Each sleeve section may comprise a top portion 312, a base portion 316, and a center column portion 314 which connects the top portion and the base portion. Each sleeve section may also comprise a means for connecting the sleeve sections at the top and/or bottom of the protective sleeve. Shown in FIG. 3A is a connecting notch 318 positioned on facing sides of the top portion 312 of each sleeve section.

As shown in FIG. 3B, the protective sleeve which covers each column (300A or 300B) of the double bit may comprise two sleeve sections, wherein each sleeve section may comprise a top portion (312*a*, 312*b*), a base portion (316*a*, 316*b*) and a center column portion (314*a*, 314*b*) which connects the top and base portions. In certain embodiments, the base portion (316*a*, 316*b*) of each sleeve section may extend outward and may cover the base region of the double bit. This not only aids in further protecting surfaces which may come into contact with the rope, but may also act to stop rotation of the sleeve on the bit. A predrilled channel 336 may extend through the base portion 316 of each sleeve section and may provide a means for connecting the at least two sleeve sections around each column (300A or 300B) using a screw or nut and bolt set.

Figure 3D:
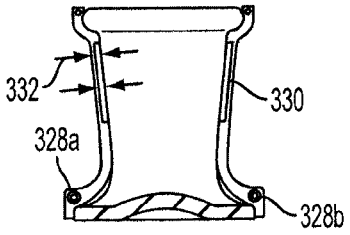
FIG. 3D is a cross-sectional view taken through line 3D-3D of the boat double bit partially covered by the protective cover shown in FIG. 3C.

Shown in FIG. 3C is a projection 330 which extends from an end portion of one sleeve section and which is configured to fit within an indent on an end portion of an adjacent sleeve section (shown as 332 in FIG. 3D). Diameters "c" and "d" are also shown and may depend on at least the size of the equipment and the materials of the sleeve sections.

Figure 3E:
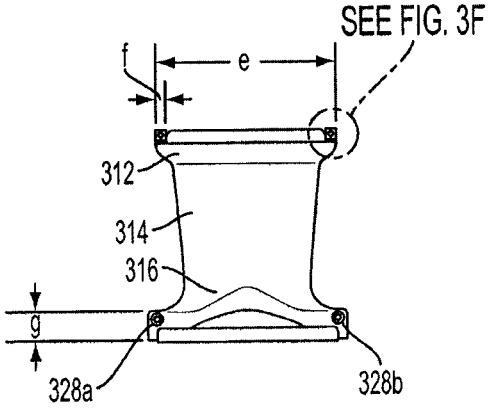
FIG. 3E is an end view of the boat double bit covered by the protective cover shown in FIG. 3C.
Figure 3F:
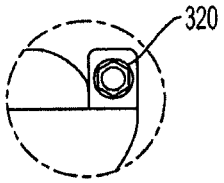
FIG. 3F illustrates an exploded view of a portion of the protective cover shown in FIG. 3D pointing out the connection point between two portions of the protective cover in accordance with certain aspects of the present invention.

FIG. 3D shows a cross-sectional view of the double bit partially covered by the protective sleeve taken along line 3D-3D of FIG. 3C. The top portion 312, center column portion 314, and base portion 316 are shown, as well as pre-drilled channels positioned in the base portions having connection means (screw or nut and bolt) inserted therein (328*a*, 328*b*). Screws or nut and bolt sets may be used to secure the protective sleeve sections around each column of the double bit. Diameters "e", "f" and "g" are shown in FIG. 3E and may depend on at least the size of the equipment and/or the materials of the protective sleeve. FIG. 3F illustrates an exploded view of the connection means from FIG. 3D, which shows a possible placement position for the nut and bolt set (320) within the top portion of the sleeve section.

An alternate embodiment of a protective sleeve for a double bit is shown in FIG. 4. As shown, the protective sleeve may have a vertical axis which is aligned with the vertical axis of each column (400A, 400B) of the double bit. Each sleeve may comprise at least two sleeve sections, where each sleeve section may be screwed or bolted to an adjacent sleeve section, and may cover at least a portion of a column (400A, 400B). Each sleeve section may comprise a top rim portion (412*a*, 412*b*), a center column portion (414*a*, 414*b*), and a bottom portion (416*a*, 416*b*). Further, each sleeve section may also comprise a first vertical end portion and a second vertical end portion. In certain embodiments of the sleeve, each sleeve section may further comprise at least one connecting notch 418 on an exterior side which allows for easy insertion of a screw or nut and bolt set 422.

Another alternate embodiment of a protective sleeve for a double bit is shown in FIG. 5. This embodiment may comprise at least two sleeve sections each having a center column portion (514*a*, 514*b*) and a bottom rim portion (516*a*, 516*b*), and a cap portion (512). Each sleeve section may be screwed or bolted (screws 522) to an adjacent sleeve section and/or directly into the bit. Additionally, the cap section 512 may be screwed or bolted to an adjacent sleeve section and/or directly into the bit. Additional portions of covering material may be added at positions which may be contacted by the synthetic line. As shown in FIG. 5, the additional material 530 may be at an edge of the double bit which contacts the synthetic line such as, for example, on an outer edge of the double bit.

The presently disclosed invention may also include rope contacting structures useable on marine docks or decks. As shown in FIG. 5, the presently disclosed invention may include a double bit which comprises two columnar bit structures having predrilled channels at various positions which may be configured to accept screws or nut and bolt sets (522). In various embodiments, the double bit may be composed of durable structural materials such as polymers or may be composed of materials more commonly known in the art such as steel or iron. The double bit may also comprise projections 540 which would keep a protective cover or sleeve from rotating about the bit once installed.

Figure 6A:
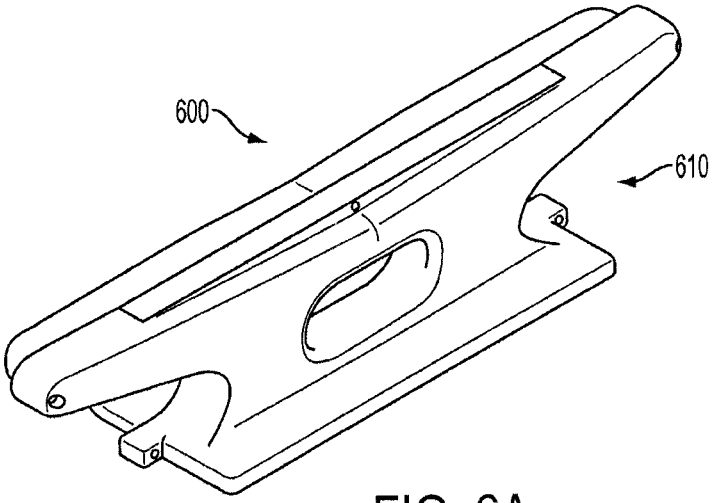
FIG. 6A-6D illustrate perspective views of a marine kevel partially covered by a protective cover in accordance with certain aspects of the present invention.
Figure 6B:
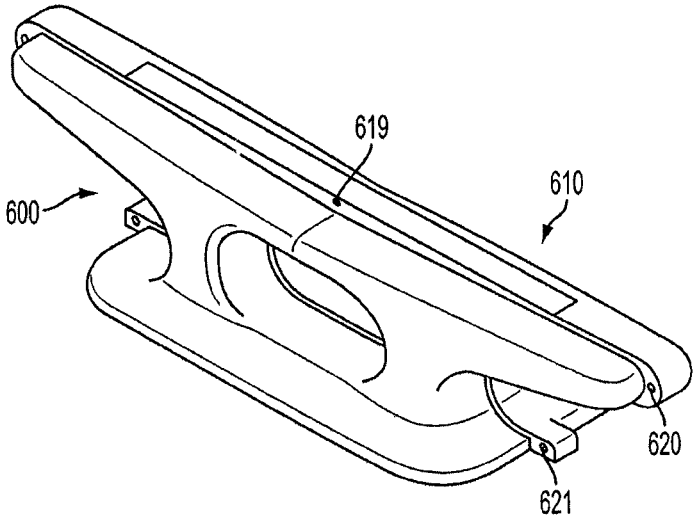
Figure 6C:
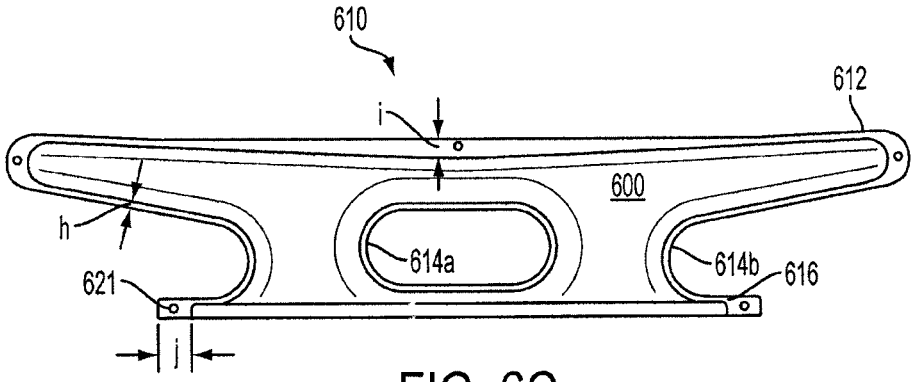

FIGS. 6A-6C illustrate perspective views of a marine kevel 600 partially covered by a protective cover according to embodiments of the presently disclosed invention. As shown, the kevel may be covered by at least two cover sections (a single section 610 is shown). Each cover section 610 may cover half of the kevel as taken along a vertical plane through the longitudinal center of the kevel. Each cover section may comprise a top portion 612, a base portion 616, and at least one center column portion (614*a*, 614*b*) which connect the top portion and the base portion. Each cover section may further comprise a lateral end portion which defines an edge or end.

Each cover section may also comprise a means for connecting the cover sections at the top and/or bottom of the protective cover. Shown in FIG. 6B is a connecting notch 621 having a predrilled channel positioned on facing sides or ends of the bottom portion (616, see FIG. 6C) of each cover section, and pre-drilled channels (619, 620) positioned on facing sides or ends of the top portion (612, see FIG. 6C) of each cover section.

Figure 6D:
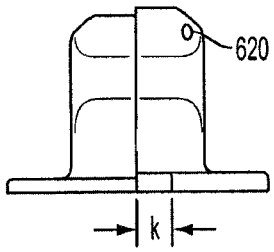

Also shown in FIGS. 6C and 6D are the diameters "h", "i", "j", and "k" which indicate the thickness of the cover section at various points. These diameters may be large enough to maintain structural integrity and strength for the sleeve section and may depend on at least the overall size of the equipment to be covered and the material of the protective sleeve.

Figure 6E:
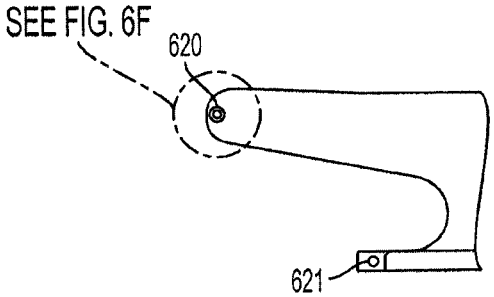
FIG. 6E illustrates a connection point between two portions of the protective cover shown in FIGS. 6A-6D in accordance with certain aspects of the present invention.
Figure 6F:
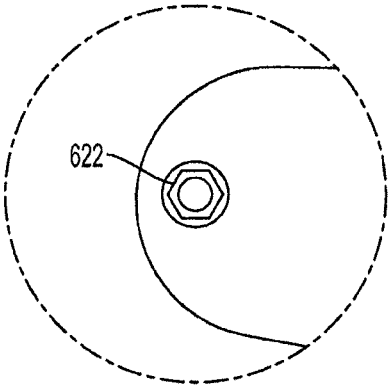
FIG. 6F illustrates an exploded view of a portion of the protective cover shown in FIG. 6E pointing out the connection point between two portions of the protective cover in accordance with certain aspects of the present invention.

Shown in FIGS. 6D and 6E is a possible placement for the predrilled channel 620 in the top portion, and the predrilled channel 621 in the bottom portion of a protective cover section. Screws or nut and bolt sets may be used to secure the protective cover sections around the marine kevel. FIG. 6F illustrates an exploded view of one connection means from FIG. 6E, which shows a possible placement position for the nut and bolt set (622) within the top portion of the cover section. As discussed above with reference to FIGS. 1D, 2C, and 3E, the connection means may be a nut and bolt, wherein the bolt may be a socket head cap screw having an outer head diameter which is the same as the matching nut. As such, the indent which accepts the nut and bolt 622 may be the same on both sides/ends of the protective cover section. This may reduce production costs for the cover sections and make installation easier as each section may be identical. Further, in certain embodiments, the indent may be hexagonal in shape and may provide a tight fit for a comparably sized nut. This may make installation of the connection means quicker and easier because only a single tool would be required to install the bolt side (via the socket head cap).

Figure 7:
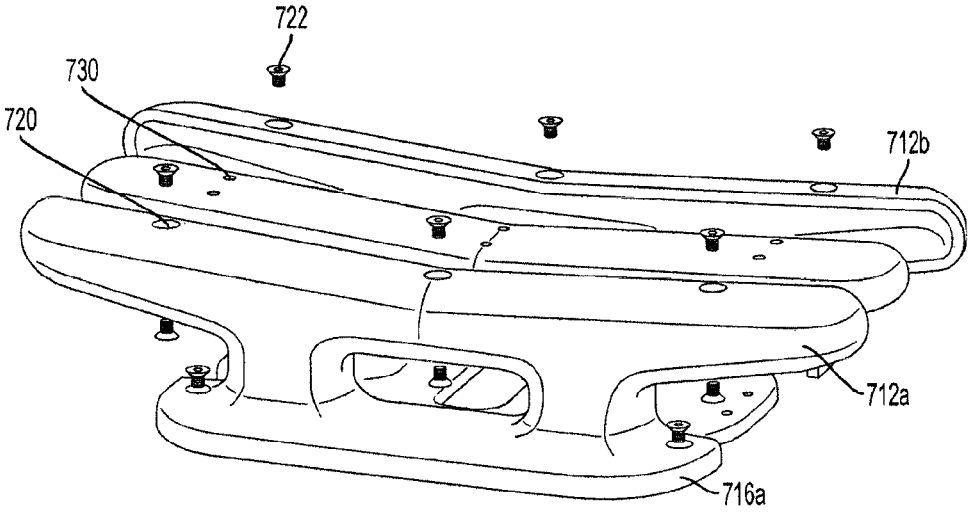
FIG. 7 illustrates perspective view of a marine kevel partially covered by an alternative embodiment of a protective cover in accordance with certain aspects of the present invention.

An alternate embodiment of a protective cover for a kevel is shown in FIG. 7. As shown, this embodiment may comprise at least two cover sections which may have an upper portion (712*a*, 712*b*), at least one center column portion, and a bottom portion (716*a*). Further, one cover section may be screwed or bolted to an adjacent cover section and/or directly into the kevel. As an example, screws 722 may be placed through predrilled channels 720 in the cover section and 730 in the kevel along an upper portion, a lower portion, or both. In alternative embodiments, the two cover sections may comprise other attachment means such as, for example, magnets, adhesives, tapes (UHB, 3M™ VHB™), or hook and loop closures, on either the lateral an internal surface which is adjacent to the peripheral surface of the cleat or kevel. These attachment means may be used alone, in combination, or in combination with a screw to attach the cover to the cleat or kevel.

The protective sleeves and covers of the presently disclosed invention are intended to be used to protect synthetic line from abrasion or damage on structures intended for contact with wire rope. As such, at least one protective cover or sleeve section may be placed adjacent to the structure so that a first end portion of the at least one sleeve section is proximate to a second end portion of either the same sleeve section or an adjacent sleeve section. The at least one section may comprise magnets which act to releasable hold the section onto the structure. The at least one section may then be secured around the structure by attaching the first end portion to the proximate second end portion. The attachment may be by any means previously disclosed. In embodiments where the sleeve or cover is portable, no attachment may be needed at the first and second ends and the sleeve or cover may be held in place by the magnets.

Figure 10:
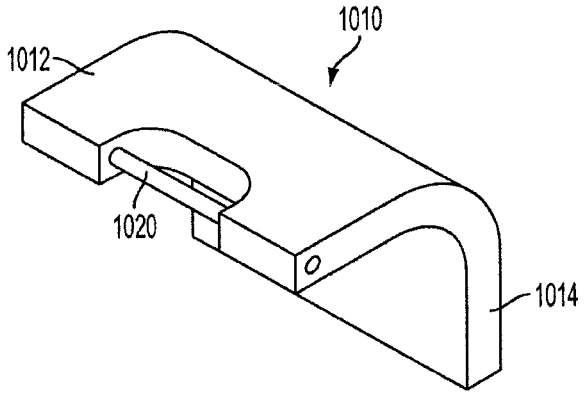
FIG. 10 illustrates a perspective view of a corner or edge protective cover in accordance with certain aspects of the present invention.

Shown in FIG. 10 is a protective cover 1010 for a rope contacting surface. The rope contacting surface may be an edge or corner of a marine vessel or dock, and the protective cover 1010 may be shaped to conform to an edge or corner of the marine vessel or dock. In an embodiment, the protective cover 1010 may have an upper portion 1012, and a lower portion 1014 and may be attached to the deck of the marine vessel or to the dock by a hook 1020 formed on the upper portion 1012 of the protective cover. In alternative embodiments, a screw or nut and bolt set may be used to directly attach the protective cover to the deck of the marine vessel or to the dock. As discussed above with reference to the protective covers and sleeves, the presently disclosed protective cover may further comprise other attachment means, such as adhesives, tapes, hook and loop closures, or magnets.

Figure 11:
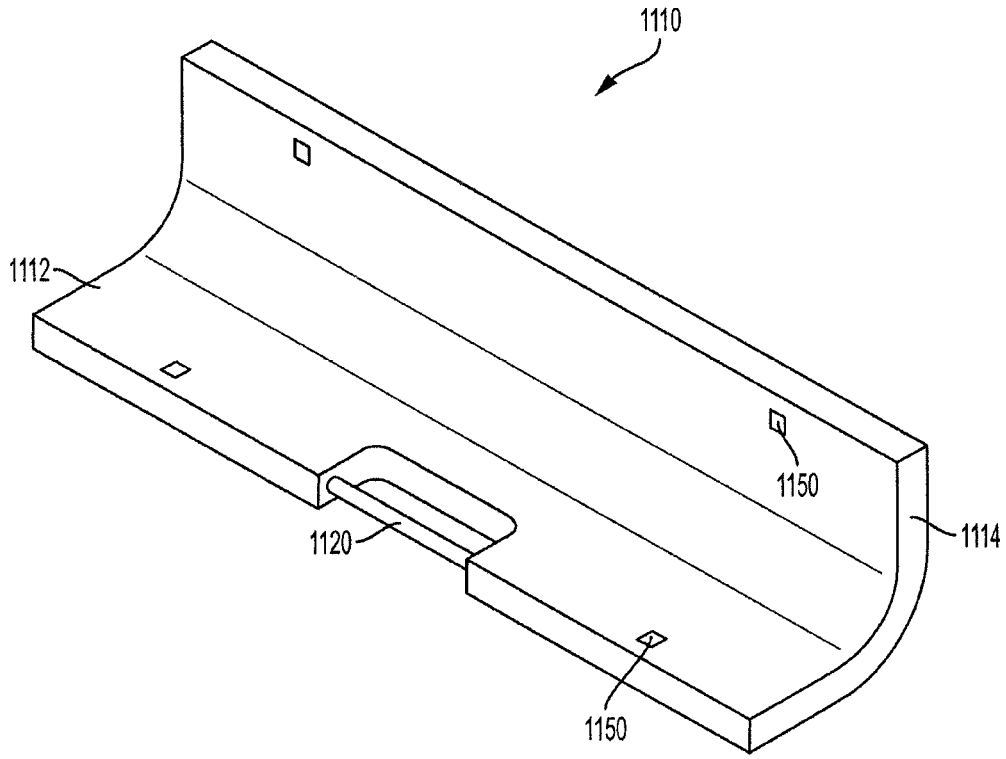
FIG. 11 illustrates a perspective view of a corner or edge protective cover in accordance with certain aspects of the present invention.

Shown in FIG. 11 is an alternative embodiment of a protective cover 1110 for an edge or corner of a marine vessel or an edge or corner of a dock which may come into contact with a synthetic line. The protective cover 1110 may be shaped to conform to an edge or corner of the marine vessel or dock as described above. As such, the protective cover 1110 may have an upper portion 1112 and a lower portion 1114 and may be attached to the deck of the marine vessel or to the dock by a hook 1120. Further, the protective cover may comprise at least one magnet 1150 which is positioned on an inner surface of the cover and which is configured to contact the peripheral surface of the rope contacting structure (corner or edge surfaces).

Figure 13:
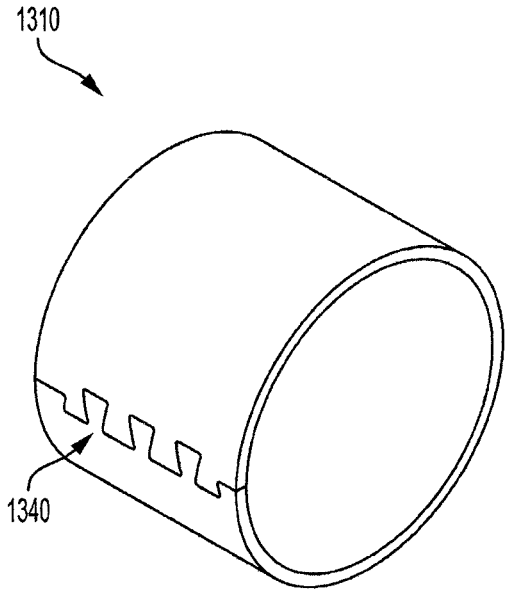
FIG. 13 illustrates a perspective view of a protective drum cover in accordance with certain aspects of the present invention.

Also included in the presently disclosed invention are protective covers for the drums of a winch or capstan. Embodiments previously described and shown to cover buttons and bits may also be used to cover the rope contacting surfaces of a winch or capstan drum. Alternatively, and as shown in FIG. 13, a cover 1310 specifically designed to cover a drum on a winch or capstan is also included in the presently disclosed invention. The cover 1310 may include a sleeve comprising interlocking teeth 1340. These teeth may have a keystone design (as shown) or may include any other type of projection and indent that may allow adjacent ends of two sleeve sections, or opposite ends of a single sleeve section, to be attached and to form a smooth surface over which the synthetic line may pass. In the embodiment shown in FIG. 13, the cover may comprise a single sleeve section 1310 which may be flexible enough to be formed around the drum and locked thereon using the interlocking teeth 1340. An inner surface of the cover 1310 which is adjacent to the peripheral surface of the drum may further comprise an additional connection means such as, for example, magnets, tapes (UHB, 3M™ VHB™) or hook and loop fasteners.

While the covers have been described in the contact of covering marine deck or dock structures, other embodiments and fields of use are within the scope of the presently disclosed invention. For example, the covers or sleeves disclosed herein may also be used to cover equipment used for towing, such as the winches and rigging found on a tow truck or vehicle, or for rigging, such as the rigging used by window washers and painters. Further, other industries may use such covers or sleeves, such as the logging industry which has recently begun to switch from wire rope to synthetic line for cable logging.

In each of the embodiments shown and discussed herein, the sleeves or covers may be composed of durable polymers such as, for example, nylon, polyester, polyether, polyurethane, specially blended urethane polymers, polyethylene, polytetrafluorethylene, high molecular weight polyethylene, ultra high molecular weight polyethylene, or hard rubber combined with other materials. In general, any durable polymer having a Shore D hardness of greater than about 60 or a Shore A hardness of greater than about 85 may be used to form the protective sleeves or covers of the presently disclosed invention. In certain embodiments, the durable polymer material may be thermosetting cast polyurethane having a Shore D hardness of about 65 or a Shore A hardness of about 95. In certain embodiments, the polymeric material may be polyurethane formed from the polyol polytetramethylene ether glycol (PTMEG) and an isocyanate. Such durable polymers may create a low coefficient of friction surface that reduces the wear and damage to synthetic line yet may be strong enough to withstand the rigors of wire rope in the event a user chooses to use such.

In certain embodiments, the durable polymeric material may further comprise a backing or embedded material which may reinforce the sleeve or cover sections. For example, fiberglass fibers may be incorporated as a backing material during the casting process. The fibers may be provided as an open weave or may comprise chopped fibers which are distributed throughout the polymeric material. The added reinforcing materials may be used to help the disclosed covers and sleeves resist high pressures or localized strains when under load with a synthetic line.

The choice of the hardness of the polymer material may be dictated by the final use and thickness of the cover. In each of the aforementioned examples (see for example FIGS. 1-3), the cover or sleeve sections are shown to have varying thicknesses throughout their profile. In certain embodiments, however, each sleeve section may be formed with a uniform thickness throughout the profile such as, for example, 1 inch. In other embodiments, such as the sleeve shown in FIG. 13 which comprises only one section, the combination of the choice of durable polymer and sleeve thickness may provide a durable cover having enough flexibility to be opened around the equipment and closed to form the cover. For example, a polymer material having a Shore D hardness of 65 and a thickness of ½ inch may be useful to provide a winch cover.

While specific embodiments of the invention have been described in detail, it should be appreciated by those skilled in the art that various modifications and alternations and applications could be developed in light of the overall teachings of the disclosure. Accordingly, the particular arrangements, systems, apparatuses, and methods disclosed are meant to be illustrative only and not limiting as to the scope of the invention.

What is claimed is:

1. A releasable protective sleeve for a metal structure on a marine deck or dock, wherein the metal structure is used for rope contact, the sleeve comprising:

at least one sleeve section composed of a thermosetting cast polyurethane having a Shore D hardness of greater than about 60 or a Shore A hardness of greater than about 85, the at least one sleeve section comprising a first end portion and a second end portion, and a first axial end and a second axial end; and a means for releasably attaching the at least one sleeve section around the structure, the means comprising a screw or nut and bolt, and the at least one sleeve section comprising at least one recessed channel at each of the first end portion and the second end portion which is configured and sized to receive the screw or nut and bolt, wherein the releasable protective sleeve is shaped to conform to an outer peripheral surface of the structure, the protective sleeve providing a smooth outer surface which lacks protrusions and is suitable for contact with a synthetic line.

2. The protective sleeve of claim 1, wherein the means for releasably attaching the at least one sleeve section further comprises tapes, adhesives, magnets, hook and loop closures, or combinations thereof.

3. The protective sleeve of claim 1, wherein the at least one sleeve section comprises at least one row of inset teeth at each of the first end portion and the second end portion, wherein the means for attaching the at least one sleeve section comprises contact between the at least one row of inset teeth on the first end portion to the at least one row of inset teeth on the second end portion, wherein the second end portion is on a same sleeve section as the first end portion or on an adjacent sleeve section.

4. The protective sleeve of claim 1, wherein the first end portion has at least one projection configured to fit within at least one indent on the second end portion, wherein the second end portion is on a same sleeve section as the first end portion or on an adjacent sleeve section.

5. The protective sleeve of claim 1, wherein the structure is selected from the group comprising bollards, chocks, roller chocks, cleats, kevels, capstans, winches, sheaves, buttons, bits, double bits, H-bits, side bits, fairleads, fairlead rollers, pilings, dauphins, mooring rings, deck perimeters and dock perimeters.

6. The protective sleeve of claim 1, wherein each sleeve section further comprises at least one magnet attached on an inner surface thereof which is adjacent to the outer peripheral surface of the structure when the protective sleeve is engaged thereon.

7. A releasable protective cover for a metal structure on a marine deck or dock, wherein the metal structure is used for rope contact, the cover comprising:

at least two semi-cylindrical sections composed of a thermosetting cast polyurethane having a Shore D hardness of greater than about 60 or a Shore A hardness of greater than about 85, wherein each section comprises:

a base portion having a bottom axial end, wherein the base portion restricts rotational movement of the cover about the structure when the cover is installed on the structure, a top portion having a top axial end, a center column portion connecting the base portion and the top portion, a first radial end portion having an end portion surface, and a second radial end portion having an end portion surface; and a means for releasably connecting the at least two semi-cylindrical sections in face-to-face relation around the structure by connecting at least the first radial end portion surface of a first section to the second radial end portion surface of an adjacent section, wherein the means for connecting the at least two semi-cylindrical sections comprises at least one screw or one nut and bolt set, and each of the at least two semi-cylindrical sections comprise at least one recessed channel at each of the first radial end portion and the second radial end portion which is configured and sized to receive the screw or nut and bolt, wherein the cover is shaped to conform to at least a portion of an outer peripheral surface of the structure and has a vertical axis aligned with a vertical axis of the structure, and wherein the cover provides a smooth outer surface lacking protrusions which is suitable for contact with a synthetic line.

8. The protective cover of claim 7, wherein the at least two semi-cylindrical sections comprise at least one row of inset teeth at each of the first radial end portion and the second radial end portion, wherein the means for connecting the at least two semi-cylindrical sections further comprises contact between the at least one row of inset teeth on the first axial end portion of the first section and the at least one row of inset teeth on the second axial end portion of the adjacent section.

9. The protective cover of claim 7, wherein the structure on the marine deck or dock comprises a bollard, chock, roller chock, cleat, kevel, capstan, sheave, button, bit, double bit, H-bit, side bit, fairlead, fairlead roller, or piling.

10. The protective cover of claim 7, wherein the base portion of the at least two semi-cylindrical sections extends laterally outward from the center column portion, and includes a lip that conforms to a shape of a base portion of the structure.

11. The protective cover of claim 7, wherein the first radial end portion surface has at least one projection configured to fit within at least one indent in the second radial end portion surface of an adjacent semi-cylindrical section.

12. The protective cover of claim 7, wherein each semi-cylindrical section further comprises at least one magnet attached on an inner surface thereof which is adjacent to the outer peripheral surface of the structure when the protective cover is engaged thereon.

13. A protective cover for a cleat or kevel on a marine deck or dock, the cover comprising:

two sections shaped to conform to an outer peripheral surface of the cleat or kevel, each section composed of a thermosetting cast polyurethane having a Shore D hardness of greater than about 60 or a Shore A hardness of greater than about 85, wherein each section comprises:

a base portion, a top portion, at least one center column portion connecting the base portion and the top portion, a lateral edge having at least one channel therethrough; and means for releasably connecting the two sections in face-to-face relation by contacting the lateral edges of each section, wherein the means for releasably connecting the two sections is a screw or nut and bolt, wherein the at least one channel is configured and sized to receive the screw or nut and bolt, wherein the protective cover provides a smooth outer surface lacking protrusions which is suitable for contact with a synthetic line.

14. The protective cover of claim 13, wherein each section further comprises at least one magnet attached on an inner surface thereof which is adjacent to the outer peripheral surface of the cleat or kevel when the protective cover is engaged thereon.

15. The protective sleeve of claim 1, wherein the at least one recessed channel at each of the first end portion and the second end portion comprises:

a top recessed channel positioned at or proximal to the top axial end of each of the first end portion and the second end portion of the at least one sleeve section; and a bottom recessed channel positioned at or proximal to the bottom axial end of each of the first end portion and the second end portion of the at least one sleeve section.

16. The protective sleeve of claim 1, wherein the thermosetting case polyurethane is formed by reaction of a polytetramethylene ether glycol with an isocyanate.

17. The protective cover of claim 7, wherein the at least one recessed channel at each of the first radial end portion and the second radial end portion comprises:

a top recessed channel positioned at or proximal to the top axial end of each of the first radial end portion and the second radial end portion of the at least one sleeve section; and a bottom recessed channel positioned at or proximal to the bottom axial end of each of the first radial end portion and the second radial end portion of the at least one sleeve section.

18. The protective cover of claim 7, wherein the thermosetting case polyurethane is formed by reaction of a polytetramethylene ether glycol with an isocyanate.

19. The protective cover of claim 13, wherein the at least one channel of the lateral edge comprises:

a left top recessed channel positioned at a left end of the top portion, and a right top recessed channel positioned at a right end of the top portion; and a left bottom recessed channel positioned at a left end of the bottom portion, and a right bottom recessed channel position at a right end of the bottom portion.

20. The protective cover of claim 13, wherein the thermosetting case polyurethane is formed by reaction of a polytetramethylene ether glycol with an isocyanate.

* * * * *